US008143808B2

(12) United States Patent
Reinle

(10) Patent No.: US 8,143,808 B2
(45) Date of Patent: Mar. 27, 2012

(54) CIRCUIT FOR A MOTOR VEHICLE, IN PARTICULAR FOR ACTUATING A LIGHTING DEVICE

(75) Inventor: Thomas Reinle, Unterhaching (DE)

(73) Assignee: Johnson Controls Technology Company, Holland, MI (US)

( * ) Notice: Subject to any disclaimer, the term of this patent is extended or adjusted under 35 U.S.C. 154(b) by 477 days.

(21) Appl. No.: 12/367,209

(22) Filed: Feb. 6, 2009

(65) Prior Publication Data

US 2009/0184663 A1 Jul. 23, 2009

(51) Int. Cl.
*H05B 41/36* (2006.01)

(52) U.S. Cl. ..... 315/294; 315/314; 362/227

(58) Field of Classification Search ..... 315/294, 315/314, 77, 82, 80; 362/227
See application file for complete search history.

(56) References Cited

U.S. PATENT DOCUMENTS

| | | | | |
|---|---|---|---|---|
| 6,414,437 | B1 * | 7/2002 | Diez et al. | 315/77 |
| 2004/0080273 | A1 * | 4/2004 | Ito et al. | 315/77 |
| 2004/0208011 | A1 | 10/2004 | Horiuchi et al. | |
| 2005/0104542 | A1 | 5/2005 | Ito et al. | |
| 2005/0236999 | A1 | 10/2005 | Ito et al. | |
| 2006/0108933 | A1 | 5/2006 | Chen | |

FOREIGN PATENT DOCUMENTS

| | | | |
|---|---|---|---|
| DE | 10115388 | A1 * | 10/2002 |
| DE | 10346528 | A1 | 4/2004 |
| DE | 102005047610 | A1 | 4/2006 |
| DE | 102006032247 | A1 | 1/2007 |
| DE | 102006005521 | B3 | 5/2007 |
| EP | 1006506 | A1 | 6/2000 |
| EP | 1113708 | A2 | 7/2001 |
| EP | 1624560 | A1 | 2/2006 |
| WO | 2004021744 | A1 | 3/2004 |
| WO | 2006012633 | A1 | 2/2006 |

* cited by examiner

*Primary Examiner* — Daniel D Chang
(74) *Attorney, Agent, or Firm* — Fletcher Yoder P.C.

(57) ABSTRACT

A circuit is provided for actuating a lighting device in a motor vehicle. The circuit includes first and second light sources, that may include one or more light-emitting diodes. The light sources are connected in parallel, and each have a respective heat sink. Measuring means is configured to determine the functionality of the first and second light sources.

12 Claims, 5 Drawing Sheets

CIRCUIT FOR A MOTOR VEHICLE, IN PARTICULAR FOR ACTUATING A LIGHTING DEVICE

CROSS REFERENCE TO RELATED APPLICATIONS

Figure 1:
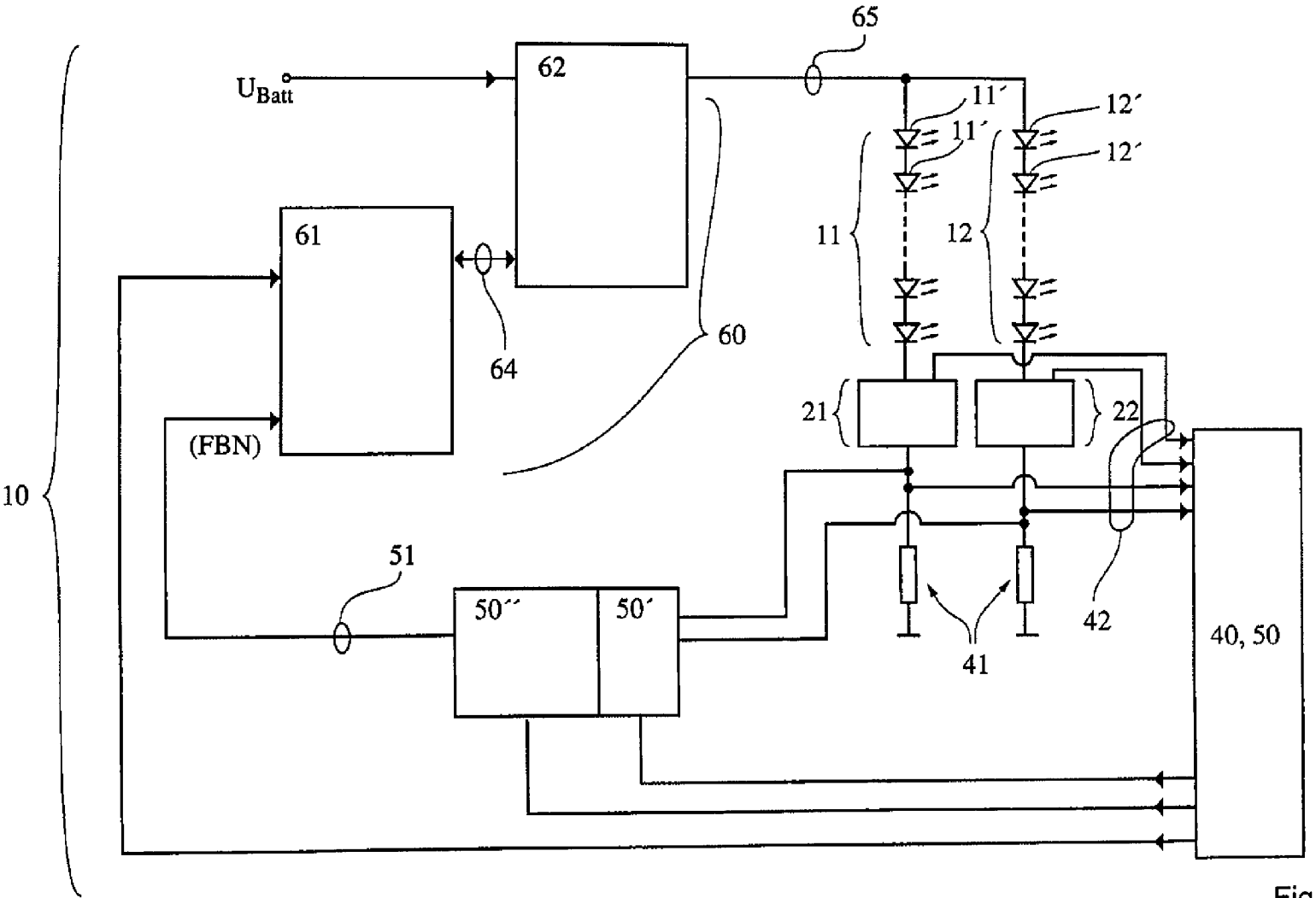

This application claims priority from and the benefit of PCT Application No. PCT/EP2007/007010, filed on Aug. 8, 2007, entitled "Circuit for a Motor Vehicle, in Particular for Actuating a Lighting Device", which is herein incorporated by reference.

BACKGROUND

The present invention relates to a circuit for a motor vehicle, in particular for actuating a lighting device, the circuit having a first light source and a second light source connected in parallel, the first light source being assigned a first current sink and the second light source being assigned a second current sink, and the circuit being assigned a measuring means.

Such circuits for motor vehicles are generally known. For example, the German laid-open specification DE 101 15 388 A1 discloses a drive circuit for an LED array, the drive circuit comprising at least one first LED strand and at least one second LED strand, a switch being arranged in series with each LED strand and each LED strand having a supply connection, a control loop being designed in such a manner that it drives the first switch of the first LED strand so as to achieve a constant mean value of the current flowing through the first LED strand, the control loop also being designed to drive the switches of the further LED strands. The drive circuit also comprises a total current detection apparatus which can be used to determine the sum of currents through at least two LED strands.

The disadvantage of this is that a distinction is made between a so-called master LED strand and further LED strands, with the result that, in the event of a functional disturbance in the so-called master LED strand, the circuit fails, which has an adverse affect on the functional reliability of the circuit.

The object of the present invention is to provide a drive circuit for a motor vehicle, in particular for actuating a lighting device, in which lighting failures or failures of the light source or other fault states are detected and a flexible response is given to such faults. Furthermore, the intention is to minimize the thermal power loss.

SUMMARY

The object is achieved by means of a circuit for a motor vehicle, in particular for actuating a lighting device, the circuit having a first light source and a second light source connected in parallel, the first light source being assigned a first current sink and the second light source being assigned a second current sink, the circuit being assigned a measuring means, and the measuring means being intended to determine the functionality of the first light source and to determine the functionality of the second light source. According to the invention, this makes it possible to easily check the functionality of each of the light sources periodically in succession or else at the same time in a parallel manner and to bring about an adapted response. Furthermore, the parallel connection of the light sources likewise makes it possible to keep the power loss as small as possible.

According to the invention, it is also preferred for the circuit to have a first switch which is assigned to the first light source and a second switch which is assigned to the second light source, the circuit being assigned a control means in such a manner that the first switch can be switched on the basis of the functionality of the first light source and the second switch can be switched on the basis of the functionality of the second light source. According to the invention, this makes it possible to bring about selective disconnection in the event of total failure of one of the light sources and thus to minimize the power loss. Furthermore, this also reduces the costs by virtue of the fact that a higher permitted ambient temperature of the circuit is possible by reducing the thermal power loss, with the result that more cost-effective components with lower requirements can be used according to the invention in the circuit and the durability or service life of the circuit components and also of the components in the light sources (in particular light-emitting diodes), in particular, is increased.

According to the invention, it is also preferred for the circuit to have a regulator, in particular a current regulator or a voltage regulator, which is provided for the first light source and the second light source. According to the invention, this makes it possible to adapt the electrical voltages or the electric current provided at the light sources in a specific manner by virtue of the fact that only the required voltage is respectively applied in order to produce a certain light power or to achieve a particular current through the light source or through the light-emitting diodes. This also makes it possible, for instance in the event of partial failure of the light sources (alloying of one or more light-emitting diodes), to regulate the current or voltage in an adapted manner, such that the power loss continues to be reduced or the respective power loss is also reduced in other possible fault situations. If the energy loss caused by the alloying of light-emitting diodes is too high, the respective light source can be disconnected.

According to the invention, it is also preferred for the regulator to be able to be driven on the basis of the functionality of the first light source and the second light source. This makes it possible to flexibly adapt the method of operation of the circuit according to the invention to the respective functional conditions of the light sources, with the result that a particularly low level of power loss can be achieved and, furthermore, the lighting properties of the light sources also change, at most, in a manner which is invisible or at least largely invisible to a user.

According to the invention, it is also preferred that, following a change in the functionality of the first light source or the second light source, the regulator can be driven with a time delay of less than or equal to one second, preferably less than or equal to 500 ms, particularly preferably less than or equal to 300 ms, very particularly preferably less than or equal to 100 ms. This enables a rapid response or makes it possible to rapidly adapt the method of operation of the circuit to a fault situation, with the result that an impermissibly high power loss is present, at most, over a very short period of time and therefore does not damage any parts or components of the circuit. This further reduces the production costs of the circuit because more cost-effective components can be used.

According to the invention, it is also preferred for the first light source to have a first light-emitting diode, preferably a plurality of first light-emitting diodes, and/or for the second light source to have a second light-emitting diode, preferably a plurality of second light-emitting diodes. This advantageously makes it possible to use a so-called light-emitting diode chain as a light source, which has the advantage that, on the one hand, a high level of flexibility is achieved because the number of light-emitting diodes can be varied for adaptation to different lighting intensities or voltage levels or the like. Furthermore, this is also associated with a greater degree of reliability because a larger number of individual light sources are used in the lighting apparatus, with the result that the failure of a particular individual light source (in particular a light-emitting diode) has a far smaller effect than when comparatively few incandescent lamps or the like are used, for example.

According to the invention, it is also preferred that, with an adequate repetition rate, the circuit can be operated in clocked fashion, in particular with a duty ratio of the switch-on time interval to the switch-off time interval of less than or equal to 1:100, preferably less than or equal to 1:200, particularly preferably less than or equal to 1:500, very particularly preferably less than or equal to 1:1000. This makes it possible to vary the dynamic response of the lighting device in very wide limits, thus enabling a larger field of use of the circuit according to the invention as a drive circuit for lighting devices.

DRAWINGS

Exemplary embodiments of the invention are illustrated in the drawing and are explained in more detail in the following description.

FIG. 1 shows a schematic illustration of a first embodiment of the circuit according to the invention.

Figure 2:
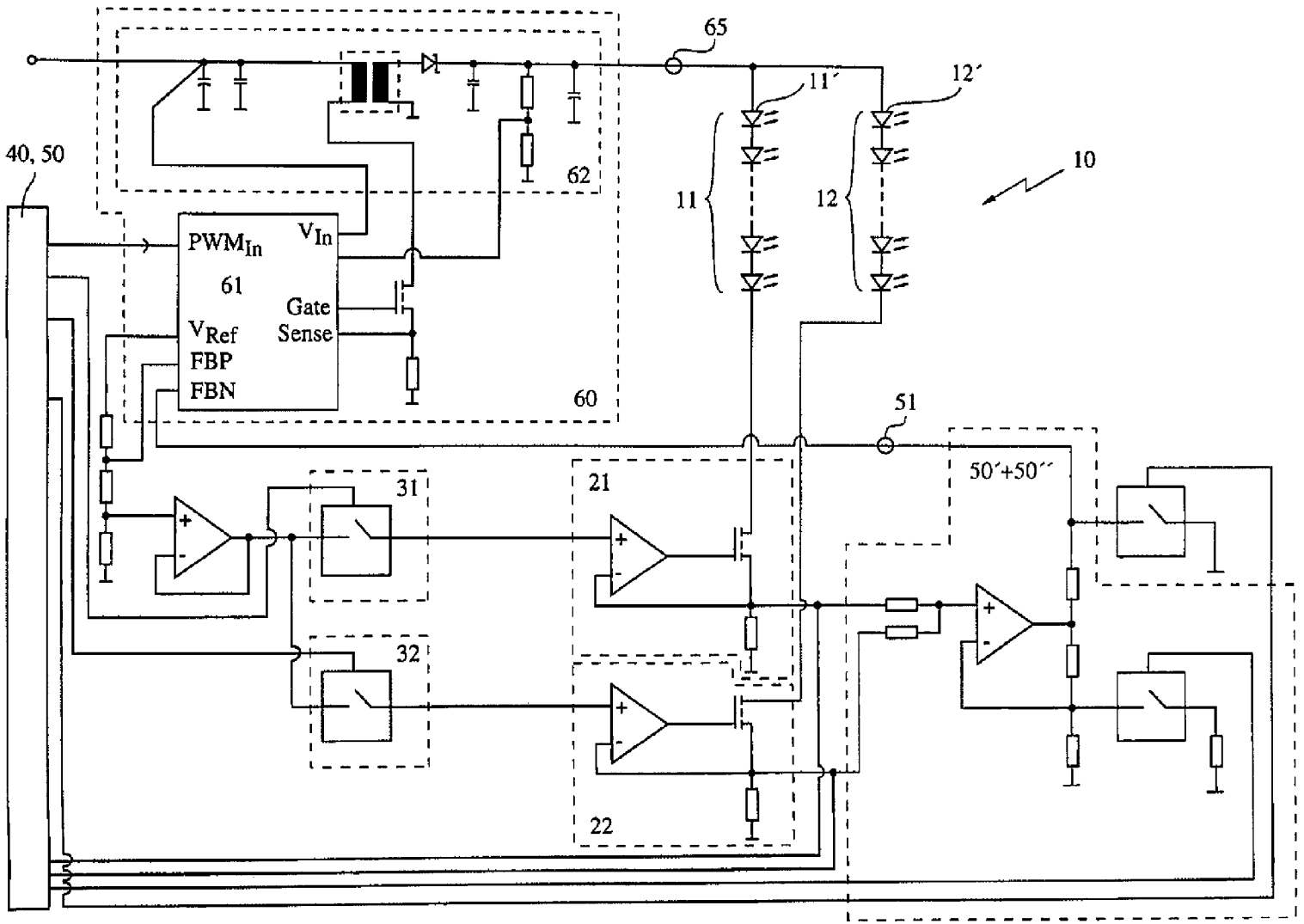

FIG. 2 schematically shows the first embodiment of the circuit according to the invention with more details.

Figure 3:
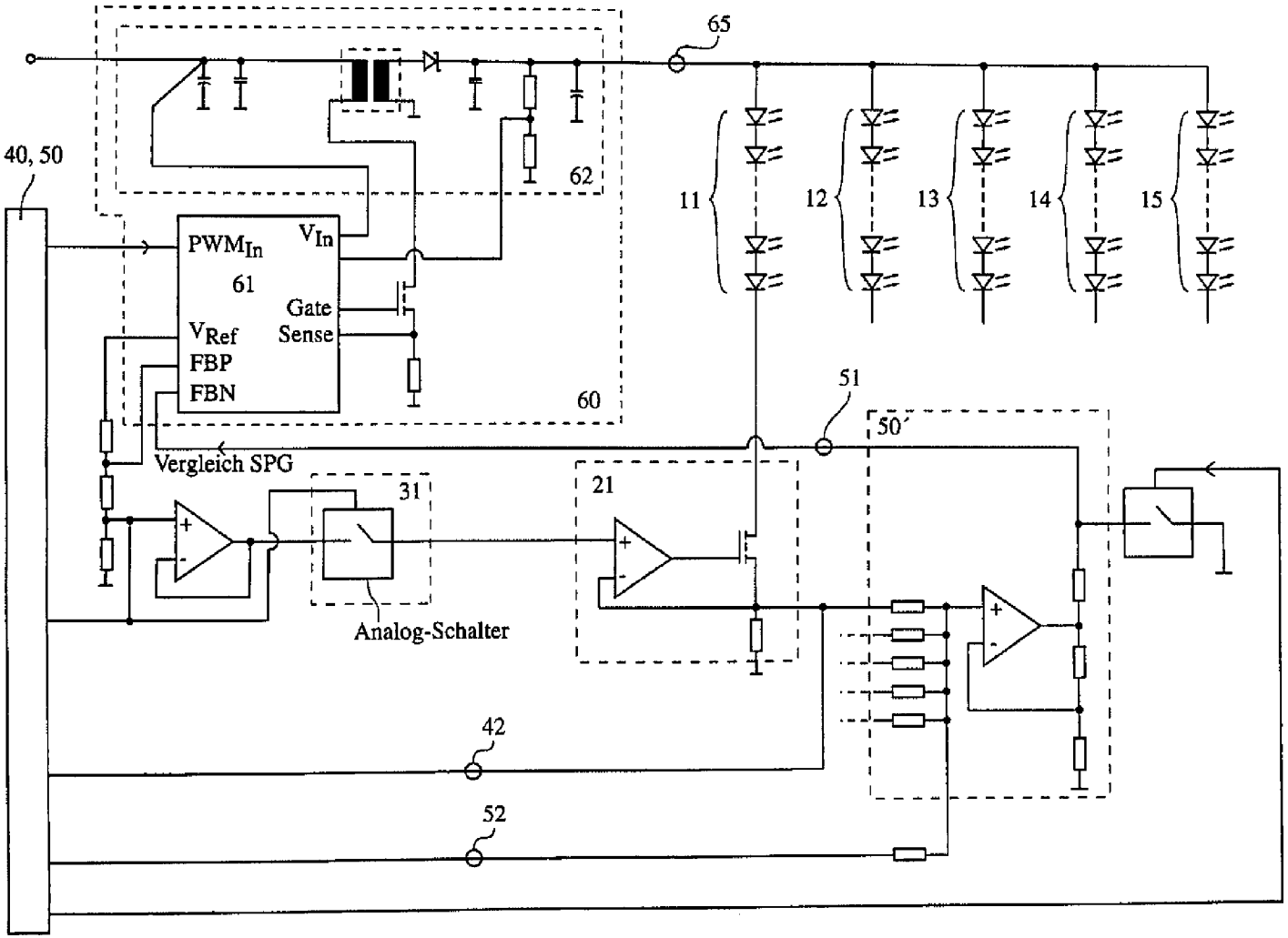

FIG. 3 schematically shows a second embodiment of the circuit according to the invention.

Figure 4:
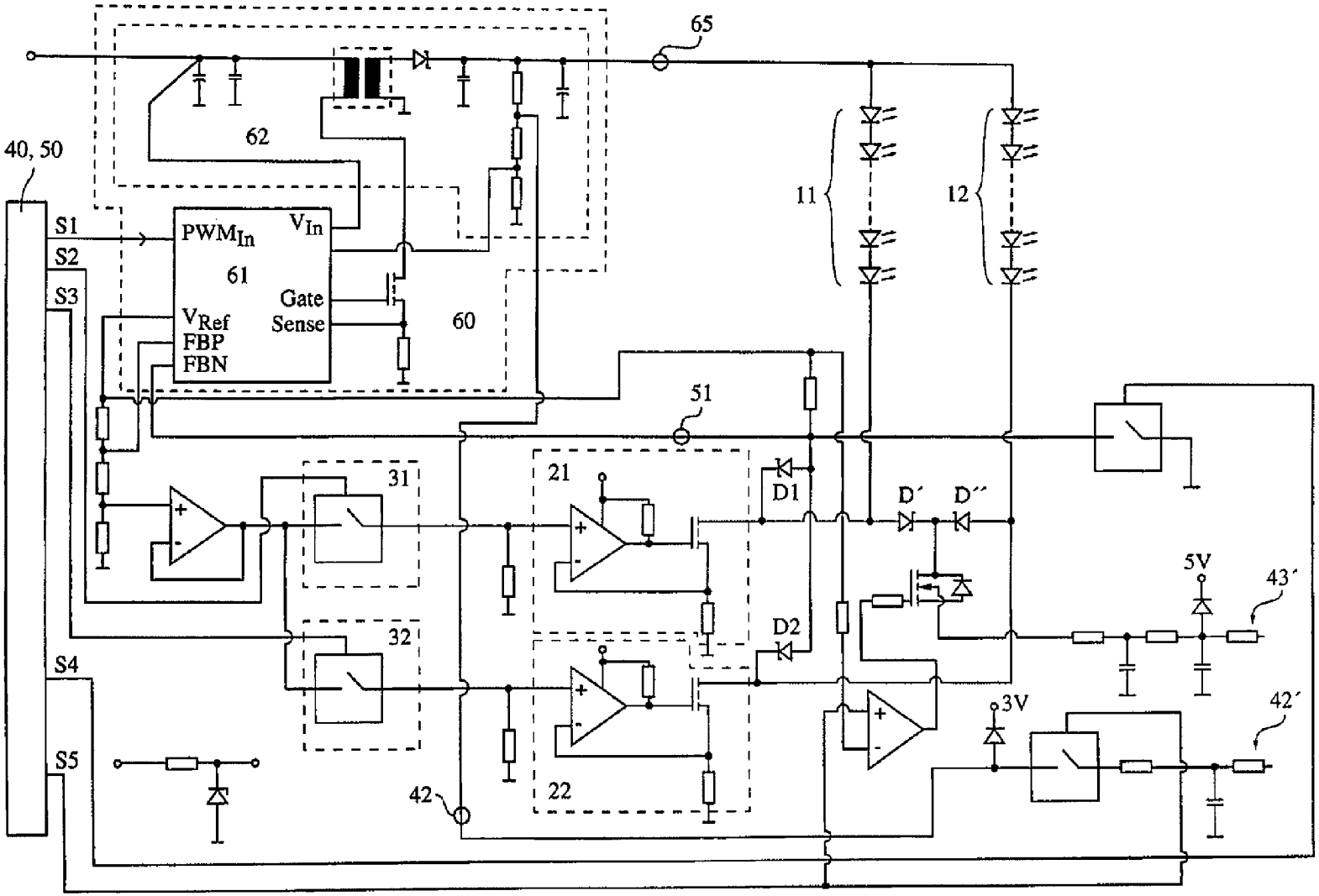

FIG. 4 schematically shows a third embodiment of the circuit according to the invention.

Figure 5:
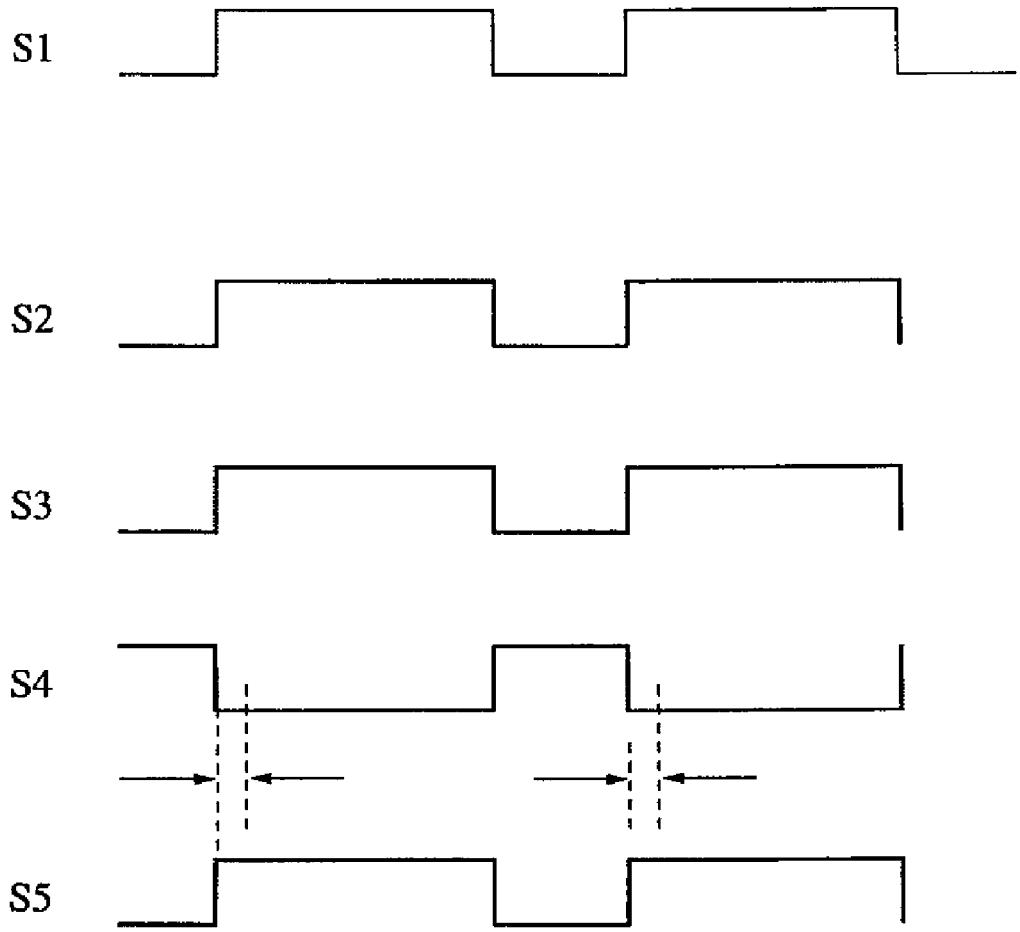

FIG. 5 schematically shows a timing diagram for illustrating different switching states at important points of the third embodiment of the circuit according to the invention.

DETAILED DESCRIPTION

FIG. 1 schematically illustrates a circuit 10 according to the invention, the circuit 10 being intended, in particular, to actuate a lighting device. For this purpose, the circuit 10 has, for example, a first light source 11 and a second light source 12. The light sources 11, 12 are provided, in particular, in the form of so-called chains of light-emitting diodes, the first light source having a first light-emitting diode 11' and preferably a plurality of first light-emitting diodes 11' and the second light source 12 having a second light-emitting diode 12' and preferably a plurality of second light-emitting diodes 12'. According to the invention, the light sources 11, 12 are each connected to a current sink (alternatively a current source) or are assigned to the latter, the first light source 11 being assigned to a first current sink 21 and the second light source 12 being assigned to a second current sink 22. In this case, an arrangement comprising a transistor, in particular a so-called MOSFET transistor (metal oxide semiconductor field effect transistor) or alternatively a bipolar transistor, and an operational amplifier is provided, in particular, as the current sinks 21, 22. The circuit 10 also has a regulator 60 which regulates the voltage level (or current level) which is applied to the light sources 11, 12 which are connected in parallel. The invention provides a connection to a measuring means 40 both from the arrangement comprising the first light source 11 and the first current sink 21 and from the arrangement comprising the second light source 12 and the second current sink 22, said measuring means being able to check the functionality of the first light source 11 and the second light source 12. According to the invention, this checking operation takes place either continuously (that is to say at the same time for the first light source 11 and for the second light source 12 in a parallel manner) or else sequentially (that is to say the light sources 11, 12 are switched on in succession and the respective result is supplied to the measuring means 40). The measuring means 40 is also connected to a control means 50 or is combined or else integrated with the latter, the control means 50 being used to influence the behavior of the circuit 10 in such a manner that, in the event of the first light source 11, for example, failing, the corresponding first current sink 21 and thus the entire circuit branch of the first light source 11 (also referred to below as the light-emitting diode strand or LED strand) are also disconnected. It goes without saying that the same also applies to the second light source 12. The invention also provides for the measuring means 40 to also make it possible to determine whether, for example, one of the first light-emitting diodes 11' and one of the second light-emitting diodes 12' are alloyed (that is to say have a low impedance) and thus no longer produce a voltage drop which, with the feed voltage applied to the corresponding LED strand remaining the same, results in a larger power loss which should be kept as small as possible according to the invention. If the power loss in the current sink becomes too large on account of the alloying of light-emitting diodes, the latter may be selectively disconnected. According to the invention, the regulator 60 comprises, in particular, a current regulator or a voltage regulator, a first regulating component 61, for example in the form of an integrated circuit, being able to be used, for instance, as an example of a current regulator, and the regulator 60 also being able to have a second regulating component 62, for example in the form of a so-called DC/DC converter part. In this case, on the basis of the battery voltage $U_{batt}$ applied to the circuit 10, the regulator 60 generates or regulates the respectively required voltage at the input 65 of the LED strands or light sources 11, 12, which are connected in parallel, with the result that the current required by the light sources 11, 12 can flow.

The circuit according to the first embodiment of the invention functions as follows:

The second regulating component 62 is connected to an output 64 of the first regulating component 61 (actual current regulator) and the light sources 11, 12 are connected to said second regulating component. Each light source 11, 12 comprises one of the light-emitting diode branches which are regulated to a current intensity which is exactly the same as far as possible by means of the current sinks 21, 22. In this case, the current sinks 21, 22 may also be in the form of current sources. The currents flowing through the light sources 11, 12 are respectively added by an adder 50' via a so-called sense resistor 41 (for example of a size of 470 mΩ). In parallel with this operation, the information relating to the functionality of the first and second light sources 11, 12 is supplied to the measuring means 40 by means of corresponding measuring lines 42. The measuring means 40 and the control means 50 are now able to drive the adder 50' (with a downstream voltage amplification regulation means 50") in such a manner that a voltage level, which is supplied to a control connection (feedback connection, likewise denoted using the reference symbol 51 in the text below) of the first regulating component 61, is applied to an output 51 of the adder 50' and the voltage amplification regulation means 50", with the result that the voltage regulation at the input 65 of the light sources 11, 12 can respond to the changed situation (for example failure of one of the LED strands) in an adequate manner, that is to say by applying a sufficient voltage level.

This method of operation shall be described below using an example. If, for example, two LED branches (light sources 11, 12) are each operated with 150 mA, the regulator 60 is intended to regulate the current flowing on the line 65 to a total of 300 mA. If only one of the LED branches is operated, the regulator 60 is intended to supply only 150 mA. The voltage amplification regulation means 50" which can be switched over is required for this purpose in the first embodiment of the circuit 10 according to the invention. If a total of two LED branches are operated (each with 150 mA) and one of them fails, the voltage at the output of the arrangement comprising the adder 50' and the voltage amplification regulation means 50" must be amplified by a factor of two so that the required voltage is doubled at the feedback input 51 of the first regulating component 61 (which, on account of the method of operation of the first regulating component 61, results in the current regulator 60 regulating only to 150 mA). If, in the event of such a failure of one of the LED strands, the flow of current through this failed LED strand stops, the regulation means of the circuit 10 first of all responds in such a manner that the voltage level at the input 65 of the light sources 11, 12 is stepped up to the maximum set limit voltage of the first regulating component 61 (because an excessively low voltage is applied to the feedback input 51 of the first regulating component 61). However, in such a situation, the current in the LED branch or light source 11, 12 which is still functioning is still kept constant at 150 mA, which can be attributed to the function of the constant current sinks 21, 22. Therefore, the remaining voltage drop must finally be brought under control using the functioning current sink 21, 22, with the result that a very large power loss momentarily occurs. This state must be prevented with a delay time which is as short as possible. For this purpose, the measuring means 40 uses the measuring lines 42 to detect that one of the LED strands or one of the light sources 11, 12 has failed, and the corresponding LED branch is disconnected. The voltage at the output of the voltage amplification regulation means 50" is then raised again to the level in the steady state, with the result that the regulator 60 or the first regulating component 61 can regulate back to the normal voltage level at the input 65 of the light sources 11, 12 again. The circuit 10 according to the invention thus ensures that there are no unstable states. There is thus no flashing either or some other impairment in the function of the light source which disturbs a user. Precisely because the defective light source is selectively disconnected, the situation is precluded in which the light source functions at times and then does not function again at times. When one of the light sources 11, 12 fails, only the brightness of the lighting device (which, according to the invention, is in the form of a background lighting device for a display device, in particular) decreases only by a defined value and then remains stable again, which is precisely the desired behavior of such an arrangement and is possibly not perceived at all by a user, for instance when the light sources 11, 12 fail in daylight and the decrease in the background lighting is not noticed at all on account of the ambient illumination. The brightness can be adjusted to the desired value of two or more light sources in regions by means of longer switch-on times of the light sources which are still functioning.

FIG. 2 illustrates a schematic illustration of the first embodiment of the circuit according to the invention in greater detail for the case of two light sources 11, 12. The first light source 11, the second light source 12, the first light-emitting diode 11', the second light-emitting diode 12', the first current sink 21, the second current sink 22, the regulator 60 with the first regulating component 61 and the second regulating component 62, the input 65 of the light sources 11, 12 as well as the regulating input 51 and the adder 50' with the voltage amplification regulation means 50" are again illustrated. Furthermore, the measuring means 40 and the control means 50 are likewise illustrated in the left-hand part of FIG. 2. In addition to the elements in FIG. 1, FIG. 2 furthermore also illustrates a first switch 31 and a second switch 32, the switches 31, 32 being provided for the controlled disconnection of individual light-emitting diode branches or individual light sources 11, 12. This is carried out via the control means 50 by means of corresponding control lines (not individually provided with a reference symbol).

In addition to the first and second light sources 11, 12, it goes without saying that it is possible to use further light sources in the form of further light-emitting diode branches, which are connected in parallel, in the circuit according to the first embodiment (and also the further embodiments). In this case, corresponding current sinks (not illustrated), corresponding switches (likewise not illustrated) and the corresponding control lines are required.

FIG. 3 illustrates a schematic illustration of a second embodiment of the circuit 10 according to the invention. In addition to the first light source and the second light source 11, 12, three further light sources 13, 14, 15 are schematically illustrated in this case in the form of light-emitting diode chains. According to the second exemplary embodiment of the circuit 10 according to the invention, each of the light sources 11 to 15 again has a current sink, only the first current sink 21 being illustrated in FIG. 3, however. The same applies to the switch, that is to say only the first switch 31 for the first light source 11 is illustrated in FIG. 3. In the second embodiment of the invention, the light sources 11, 12 are driven in a similar manner to that in the first embodiment of the invention by means of the regulator 60 and corresponding current sinks 21. Therefore, the regulator 60 with the first regulating component 61 and the second regulating component 62, the input 65 of the light sources 11 to 15, the regulating input 51 and the adder 50' are again illustrated. Furthermore, the measuring means 40 and the control means 50 are likewise illustrated in the left-hand part of FIG. 3.

There are differences with regard to the measuring means 40 and the evaluation of the individual light-emitting diode strands. In the second embodiment of the invention (in contrast to the first embodiment of the invention), the functions of the voltage amplification regulation means 50" (according to the first embodiment of the invention) are also undertaken by the control means 50. For this purpose, the control means 50 has an output line 52 which acts on the adder 50', with the result that the voltage needed to stabilize the control loop is applied to the output 51 of the adder 50' even when individual light-emitting diode chains or light sources fail. For each light-emitting diode branch which fails, the measuring means 40 first of all uses measuring lines 42 (only one measuring line 42 of which is illustrated for the sake of simplicity) to detect that the light-emitting diode branch has failed. The control means 50 then steps up (in particular by means of a digital/analog converter or by means of a so-called PPG (programmable pulse generator)) the input 52 of the adder 50' in such a manner that the voltage at the output 51 of the adder remains at the level needed for a regulated voltage at the input 65 of the light sources. In the example of the second embodiment shown in FIG. 3, it is the case, for example, that the current through each of the light sources is 100 mA but this value should be understood only as an example. Therefore, the voltage level on the control line 52 must be increased by (depending on the resistor configuration provided) 100 mV, for example, for each light-emitting diode chain which fails.

FIG. 4 schematically illustrates a third embodiment of the circuit 10. The first light source 11, the second light source 12, the first current sink 21, the second current sink 22, the first regulating component 61, the second regulating component 62, the first switch 31 and the second switch 32 as well as the measuring means 40 and the control means 50 are illustrated again. In contrast to the first and second embodiments of the circuit 10, there is no adder 50' for providing the voltage level required at the feedback input 51 of the first regulating component 61, but rather a first diode D1, in particular a Schottky diode, between the first current sink 21 and the feedback input 51 is used to ensure that, when the voltage level on the cathode side of the first diode D1 falls, to a very great extent, toward the ground potential on account of the first light source 11 failing, a corresponding response (on account of the diode D1 turning on) at the feedback input 51 (drop in the voltage applied there) is given in such a manner that the input voltage at the input 65 of the light sources 11, 12 is stepped up again. After the corresponding LED branch (of the first light source 11, for example, in the present case) has been switched off, the turning-on of the first diode D1 is reversed again. In a manner corresponding to the function with the first LED branch, a second diode D2, in particular a Schottky diode, between the second current sink 22 and the feedback input 51 is used to ensure that, when the voltage level on the cathode side of the second diode D2 falls, to a very great extent, toward the ground potential on account of the second light source 12 failing, a corresponding response (on account of the second diode D2 turning on) at the feedback input 51 (drop in the voltage applied there) is given in such a manner that the input voltage at the input 65 of the light sources 11, 12 is stepped up again.

The information relating to whether or not one of the light sources 11, 12 has failed is passed to the measuring means 40 via a measuring line 43 (or measuring connection 43') which is common to all light sources 11, 12. It is therefore necessary to sequentially sample the different light-emitting diode branches. The LED branch which has failed is disconnected using the switches 31, 32. A third diode D' (likewise a Schottky diode for example) and a fourth diode D" (likewise a Schottky diode for example) are used for this purpose (for the example of two light sources 11, 12). According to the third embodiment of the circuit 10 according to the invention, the input of the current sinks 21, 22 (that is to say in each case between the light sources 11, 12 and the current sinks 21, 22, thus implementing a measuring tap at this point) is connected to the anode side of either the third diode D' (first current sink) or the fourth diode D" (second current sink) for this purpose. A query regarding which voltage drop is present across the light sources 11, 12 is effected in a temporally clocked manner (that is to say sequentially) by means of control using the control means 50. If, for example, one of the light-emitting diodes has failed in both light sources 11, 12, this can be detected in the control means 50 on the basis of the measured voltage drop, and the voltage level at the input 65 of the light sources 11, 12 can be reduced in order to reduce the power loss. A further measuring connection 42' is used to measure the voltage drop across the entire light-emitting diode chain for a particular light source 11, 12. In order to illustrate the method of operation, FIG. 4 also depicts the control lines S1, S2, S3, S4 and S5 of the control means 50 or of the measuring and control means 50. In this case, the control line S1 is used to periodically switch the circuit 10 on and off when the lighting device (for instance background lighting for a display apparatus) is activated and with a duty ratio of the switch-on time interval to the switch-off time interval that is dependent on the required brightness of the light sources. The control line S2 is used to switch the first light source 11 on or off. The control line S3 is used to switch the second light source 12 on or off. The control line S4 is used to disconnect the feedback input 51 from ground potential. The control line S5 is used to sample the voltage regulation (or current regulation) at the input 65 of the light sources and on the measuring line 42 or at the measuring connection 42'.

FIG. 5 schematically illustrates a timing diagram relating to different states of the control lines S1, S2, S3, S4 and S5 of the control means 50. According to the invention, the circuit 10 is operated in clocked fashion. This means that switching-on and switching-off operations are carried out at regular intervals at a clock generator output (control line S1) which switches the entire circuit on and off. When both light sources 11 and 12 are functioning, a switching-on operation is likewise carried out synchronously on the individual switching lines (control lines S2 and S3) for the individual light sources. The result here is only a minimum time delay, between the time at which the circuit is switched on and the actual functioning of the circuit (control line S5), of, for example, approximately 1 to 40 microseconds, preferably approximately 5 microseconds (the delay time is indicated in the drawing using an arrow; in this case, the delay time can be adjusted). This can be attributed, in particular, to the fact that the adding stage is dispensed with in FIG. 4, the response times of the first and second diodes D1/D2 and of the switches 31, 32 are in the nanosecond range and the response time of the operational amplifiers of the current sinks 21, 22 could additionally be accelerated to a considerable extent because a) said operational amplifier is supplied with a high voltage (for example the battery voltage, and the voltage is limited to a defined limit value in this case) and because b) the output of the operational amplifier is biased (for example by means of a resistance to its voltage supply). As a result, when switching on the circuit, it is possible for the edge gradient to be so large that the circuit is ready for operation in 5 microseconds, for example. In the extreme case, it is thus possible for the circuit to be operated with a dynamic response of 1:1000 or even higher within a repetition time of, for example, 5 milliseconds (with a repetition rate of, for example, approximately 200 per second or else from approximately 50 per second to approximately 600 per second).

The invention claimed is:

1. A circuit for a motor vehicle, in particular for actuating a lighting device, the circuit comprising:

a first light source and a second light source connected in parallel, the first light source being assigned a first current sink and the second light source being assigned a second current sink, the circuit being assigned a measuring device, wherein the measuring device is configured to determine the functionality of the first light source and to determine the functionality of the second light source; and a first switch which is assigned to the first light source and a second switch which is assigned to the second light source, the circuit being assigned a controller in such a manner that the first switch can be switched on the basis of the functionality of the first light source and the second switch can be switched on the basis of the functionality of the second light source;

wherein the circuit has a current regulator or a voltage regulator, which is provided for the first light source and the second light source, and the regulator is driven to reduce power loss on the basis of the functionality of the first light source and the second light source.

2. The circuit as claimed in claim 1, wherein following a change in the functionality of the first light source or the second light source, the regulator can be driven with a time delay of less than or equal to one second.

3. The circuit as claimed in claim 2, wherein the regulator can be driven with a time delay of less than or equal to 500 milliseconds.

4. The circuit as claimed in claim 2, wherein the regulator can be driven with a time delay of less than or equal to 300 milliseconds.

5. The circuit as claimed in claim 1, wherein the first light source has at least a first light-emitting diode, and/or the second light source has at least a second light-emitting diode.

6. The circuit as claimed in claim 5, wherein the first light source includes a plurality of first light-emitting diodes.

7. The circuit as claimed in claim 5, wherein the second light source includes a plurality of second light-emitting diodes.

8. The circuit as claimed in claim 1, wherein the circuit can be operated in clocked fashion with a duty ratio of the switch-on time interval to the switch-off time interval of less than or equal to 1:100.

9. The circuit as claimed in claim 1, wherein a measuring tap having a diode is respectively provided between the first light source and the first current sink and between the second light source and the second current sink.

10. The circuit as claimed in claim 1, wherein the circuit can be operated in clocked fashion with a duty ratio of the switched-on time interval to the switched-off interval of less than or equal to 1:200.

11. The circuit as claimed in claim 1, wherein the circuit can be operated in clocked fashion with a duty ratio of the switched-on time interval to the switched-off interval of less than or equal to 1:500.

12. The circuit as claimed in claim 1, wherein the circuit can be operated in clocked fashion with a duty ratio of the switched-on time interval to the switched-off interval of less than or equal to 1:1000.

* * * * *